US010280614B2

(12) United States Patent
Gen

(10) Patent No.: US 10,280,614 B2
(45) Date of Patent: May 7, 2019

(54) SOUND ABSORBING STRUCTURE AND ACOUSTIC ROOM

(71) Applicant: DAIWA HOUSE INDUSTRY CO., LTD., Osaka (JP)

(72) Inventor: Haruo Gen, Osaka (JP)

(73) Assignee: DAIWA HOUSE INDUSTRY CO., LTD., Osaka (JP)

( * ) Notice: Subject to any disclaimer, the term of this patent is extended or adjusted under 35 U.S.C. 154(b) by 139 days.

(21) Appl. No.: 15/511,816

(22) PCT Filed: Jun. 19, 2015

(86) PCT No.: PCT/JP2015/067749

§ 371 (c)(1),
(2) Date: Mar. 16, 2017

(87) PCT Pub. No.: WO2016/047224

PCT Pub. Date: Mar. 31, 2016

(65) Prior Publication Data

US 2017/0284088 A1 Oct. 5, 2017

(30) Foreign Application Priority Data

Sep. 22, 2014 (JP) ..... 2014-192609

(51) Int. Cl.
*E04B 1/82* (2006.01)
*E04B 1/84* (2006.01)
(Continued)

(52) U.S. Cl.
CPC ..... *E04B 1/99* (2013.01); *E04B 1/8209* (2013.01); *E04B 1/8409* (2013.01); *G10K 11/16* (2013.01);
(Continued)

(58) Field of Classification Search
CPC ..... E04B 1/99; E04B 1/8209; E04B 1/8409; E04B 2001/8485
(Continued)

(56) References Cited

U.S. PATENT DOCUMENTS 2,007,130 A * 7/1935 Munroe ..... E04B 1/86 106/DIG. 3
2,030,157 A * 2/1936 Schlenker ..... G10K 11/172 181/30
(Continued)

FOREIGN PATENT DOCUMENTS

JP S62144304 9/1987
JP H0542421 6/1993
(Continued)

OTHER PUBLICATIONS

English translation of JP 2006-063746 A, accessed Sep. 27, 2018. (Year: 2006).*
(Continued)

*Primary Examiner* — Jeremy A Luks
(74) *Attorney, Agent, or Firm* — Hauptman Ham, LLP

(57) ABSTRACT

A sound absorbing structure (1) includes: a rear surface member (21) having a length in a predetermined direction; a front surface member (22) that is shorter in the predetermined direction than the rear surface member (21); and a sound absorbing material (3) that is placed in front of the rear surface member (21). The front surface member (22) is parallel to the rear surface member (21) and is separated forward from the rear surface member (21). An opening (23) is formed at a position adjoining the front surface member (22) in the predetermined direction. The sound absorbing material (3) is provided in both a first region (24) located
(Continued)

behind the opening (23) and a second region (25) sandwiched between the front surface member (22) and the rear surface member (21).

11 Claims, 12 Drawing Sheets

(51) Int. Cl.

| | |
|---|---|
| ***E04B 1/99*** | (2006.01) |
| ***G10K 11/16*** | (2006.01) |
| ***G10K 11/168*** | (2006.01) |
| ***G10K 11/162*** | (2006.01) |
| ***G10K 11/172*** | (2006.01) |

(52) U.S. Cl.
CPC ..... *G10K 11/162* (2013.01); *G10K 11/168* (2013.01); *G10K 11/172* (2013.01); *E04B 1/994* (2013.01); *E04B 2001/8485* (2013.01)

(58) Field of Classification Search
USPC ..... 181/30, 287, 290, 293, 295
See application file for complete search history.

(56) References Cited

U.S. PATENT DOCUMENTS 3,275,101 A * 9/1966 Davis, Jr. ..... E04B 1/86 181/285
3,621,934 A * 11/1971 Thrasher ..... E04B 1/8409 181/290
3,656,576 A * 4/1972 Gubela ..... E01F 8/007 181/210
3,846,949 A * 11/1974 Okawa ..... E01F 8/007 52/438
4,071,989 A * 2/1978 Warren ..... E04C 1/41 181/285
4,829,728 A * 5/1989 Castelli ..... E04B 9/001 181/289
4,960,184 A * 10/1990 Woodward ..... E04B 1/86 181/287
2007/0137926 A1 * 6/2007 Albin, Jr. ..... B60R 13/0815 181/290

FOREIGN PATENT DOCUMENTS

| | | |
|---|---|---|
| JP | H0657850 | 3/1994 |
| JP | H0726413 | 5/1995 |
| JP | 2005146650 | 6/2005 |
| JP | 2006-063746 | 3/2006 |
| JP | 2014-041242 | 3/2014 |
| JP | 2014141822 | 8/2014 |

OTHER PUBLICATIONS

International Search Report for corresponding International Application No. PCT/JP2015/067749, dated Sep. 8, 2015.

* cited by examiner

SOUND ABSORBING STRUCTURE AND ACOUSTIC ROOM

TECHNICAL FIELD

The present invention relates to sound absorbing structures and acoustic rooms, and more particularly to sound absorbing structures suitable for audio rooms and acoustic rooms provided with the same.

BACKGROUND ART

Rooms (audio rooms) primarily intended for playing a musical instrument such as the piano or listening to music are required not only to have sound insulating properties but also to provide great sound (acoustics). One method to create great acoustics is "sound absorption," and conventionally, there are sound absorbing ceiling materials, sound absorbing wall materials, and wall-mounted or standing sound absorbing panels.

For example, Japanese Unexamined Patent Application Publication No. 2005-146650 (Patent Literature 1) proposes a sound absorbing structure having a plurality of Helmholtz resonators formed in studs disposed in a space in a double wall in order to absorb sounds of a specific frequency in an air layer that is present in the double wall. Specifically, Patent Literature 1 discloses that each stud is formed by a hollow tube extending in the vertical direction, a plurality of openings that open to the space in the wall are formed in a side surface of the stud, and the peripheral portion of each opening has a tubular shape protruding laterally from the remaining portion.

It is known in the field of architectural acoustics that it is effective to place a sound absorbing material in a corner(s) of a room in order to reduce acoustics trouble called booming, namely unbalanced sound due to a build-up of low-pitched sounds in the corner(s) of the room. For example, Japanese Unexamined Patent Application Publication No. 2014-141822 (Patent Literature 2) proposes a technique in which a sound absorber substantially in the shape of a triangular prism is placed in a corner of an acoustic room and a thick part of the sound absorber absorbs sounds in a low frequency range and a thin part of the sound absorber absorbs sounds in a high frequency range. Patent Literature 2 also proposes that a variable mechanism that can change the exposed area of a sound absorbing surface (front surface) of the sound absorber be added so that acoustics can be changed.

CITATION LIST

Patent Literatures

Patent Literature 1: Japanese Unexamined Patent Application Publication No. 2005-146650

Patent Literature 2: Japanese Unexamined Patent Application Publication No. 2014-141822

SUMMARY OF INVENTION

Technical Problem

In the case of the substantially triangular prism-shaped sound absorber placed in the corner as in Patent Literature 2, the dimensions of the sound absorber are increased in order to enhance sound absorption performance of the sound absorber. However, if the sound absorber placed in the corner has excessively large dimensions, the space in the room is reduced, and such an excessively large sound absorber is also not desirable in terms of design. Such a sound absorber is therefore not very practical.

The technique of Patent Literature 1 requires studs with a special structure. Accordingly, a technique that improves sound absorption performance with a simple structure is desired.

The present invention was developed to solve the above problems, and it is an object of the present invention to provide a sound absorbing structure that can improve sound absorption performance with a simple structure and an acoustic room.

Solution to Problem

A sound absorbing structure according to one aspect of the present invention is a sound absorbing structure that absorbs sound and includes: a rear surface member having a length in a predetermined direction; a front surface member that is shorter in the predetermined direction than the rear surface member; and a sound absorbing material that is placed in front of the rear surface member. The front surface member is parallel to the rear surface member and is separated forward from the rear surface member. An opening is formed at a position adjoining the front surface member in the predetermined direction. The sound absorbing material is provided in both a first region located behind the opening and a second region sandwiched between the front surface member and the rear surface member.

A sound absorbing structure according to another aspect of the present invention is a sound absorbing structure that absorbs sound and includes: a rear surface member having a length in a predetermined direction; a front surface member that is parallel to the rear surface member and is separated forward from the rear surface member; and a sound absorbing material that is placed in front of the rear surface member. The front surface member has an opening partially in the predetermined direction. The sound absorbing material is provided in both a first region located behind the opening and a second region located behind a reflecting wall portion. The reflecting wall portion is the front surface member excluding the opening.

Preferably, a part of the sound absorbing material which is located in the first region absorbs sounds in a high frequency range, and a part of the sound absorbing material which is located in the second region absorbs sounds in a low frequency range.

Preferably, a length dimension in the predetermined direction of the second region is larger than that in the predetermined direction of the first region.

More preferably, when the length dimension of the first region is 1, the length dimension of the second region is 2 or more.

It is desirable that the length dimension in the predetermined direction of the second region be larger than a depth dimension of the first region.

It is desirable that the length dimension of the first region be a 0.5 module.

Preferably, the sound absorbing structure further includes: a low-pitched sound acoustics variable mechanism that is disposed in the second region and that can change acoustics in the low frequency range.

Alternatively, the sound absorbing structure may further include: a low-pitched sound acoustics variable mechanism including a partition member that adjusts an opening area of a passage for the sounds in the low frequency range to travel from the first region into the second region.

The partition member may be formed by a plate-like member provided so that its angle with respect to the predetermined direction can be changed. In this case, the second region may include a void where the plate-like member can be rotated.

In particular, in the case where the sound absorbing structure does not include the low-pitched sound acoustics variable mechanism, the sound absorbing material may extend from the first region to the second region.

Preferably, the sound absorbing structure further includes: an acoustics variable mechanism that can change acoustics by adjusting an exposed area of a sound absorbing surface exposed through the opening.

The rear surface member may form at least one of sidewalls, a floor, and a ceiling of a room.

An acoustic room according to still another aspect of the present invention includes one of the above sound absorbing structures.

Advantageous Effects of Invention

According to the present invention, sound absorption performance can be improved with a simple structure. Since the thickness of the sound absorbing material need not be increased, practicality can be improved.

BRIEF DESCRIPTION OF DRAWINGS

FIG. 15(A) shows a low-pitched sound acoustics variable mechanism in a fully open state, and FIG. 15(B) shows the low-pitched sound acoustics variable mechanism in a fully closed state.

DESCRIPTION OF EMBODIMENTS

Figure 1:
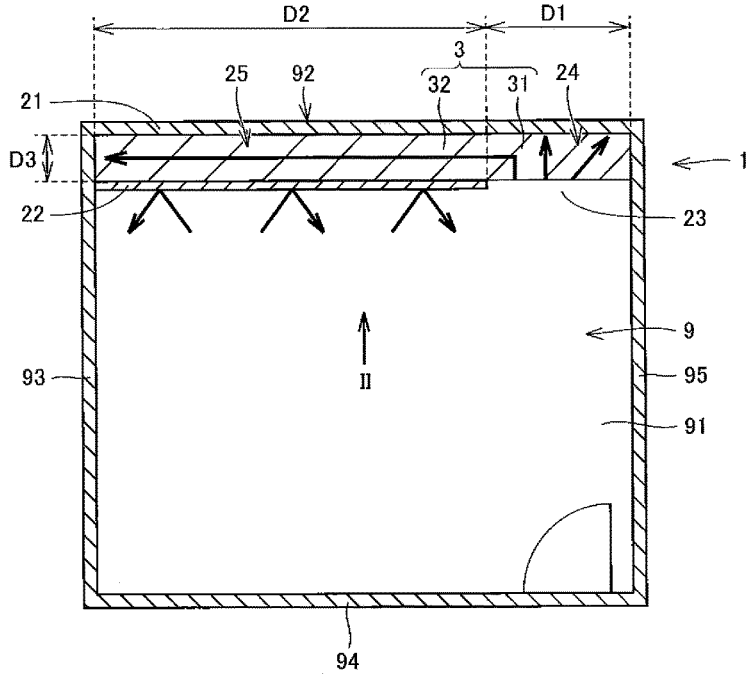
FIG. 1 is a sectional view schematically showing an acoustic room according to a first embodiment of the present invention.

Embodiments of the present invention will be described in detail below with reference to the accompanying drawings. In the figures, the same or corresponding portions are denoted with the same reference characters, and description thereof will not be repeated.

First Embodiment

First, the outline of an acoustic room according to the present embodiment will be described. In the present embodiment, "front" refers to the side closer to a sound source (the side closer to the center of the room), and "rear" refers to the side farther from the sound source.

Figure 2:
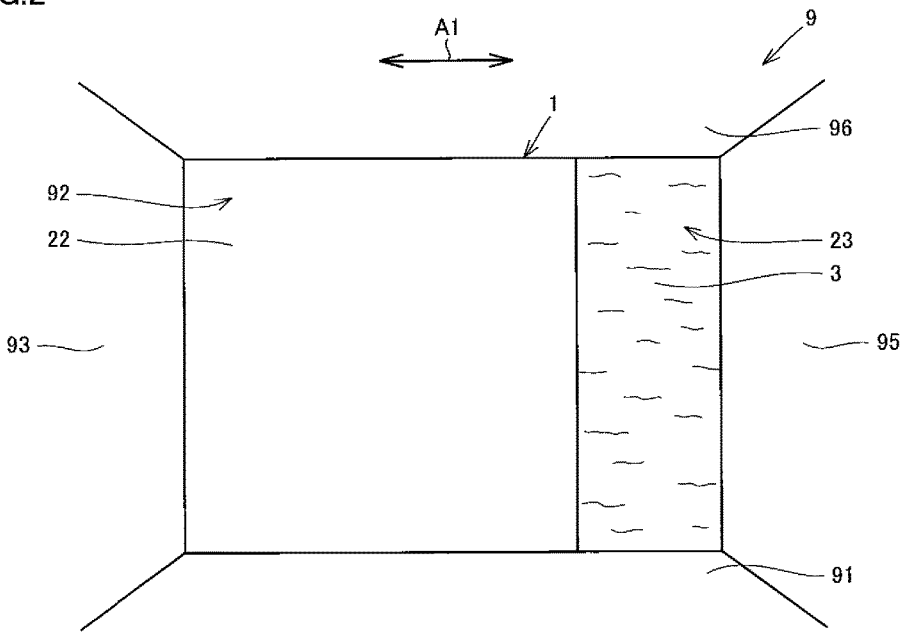
FIG. 2 is a view showing the acoustic room according to the first embodiment of the present invention as viewed from inside the room (in the direction shown by arrow II in FIG. 1).

Referring to FIGS. 1 and 2, an acoustic room 9 is a room surrounded by a floor 91, sidewalls 92 to 95, and a ceiling 96. In the present embodiment, for example, one sidewall 92 has a sound absorbing structure 1 that absorbs sound produced in the room. The sound absorbing structure 1 includes a rear surface member 21, a front surface member 22, and a sound absorbing material 3 that absorbs sound.

The rear surface member 21 has a rectangular shape and has a length in the vertical direction and the lateral direction. The rear surface member 21 is perpendicular to the sidewalls 93, 95 of the acoustic room 9. The front surface member 22 is parallel to the rear surface member 21 and is separated forward from the rear surface member 21. The front surface member 22 also has a rectangular shape and has a length in the vertical direction and the lateral direction. Arrow A1 in FIG. 2 indicates the lateral direction.

The rear surface member 21 and the front surface member 22 are rigid, and the front surface member 22 and the rear surface member 21 form a double wall. That is, both the rear surface member 21 and the front surface member 22 form the sidewall 92.

The front surface member 22 has a smaller lateral width than of the rear surface member 21. An opening 23 is thus formed at the position located in front of the rear surface member 21 and adjoining the front surface member 22 in the lateral direction.

The sound absorbing material 3 is disposed in a region (hereinafter referred to as the "first region") 24 exposed through the opening 23 and extends also in a region (hereinafter referred to as the "second region") 25 sandwiched between the rear surface member 21 and the front surface member 22. That is, the sound absorbing material 3 is comprised of a portion (hereinafter referred to as the "exposed sound absorbing portion") 31 located in the first region 24 and exposed in the room and a portion (hereinafter referred to as the "hidden sound absorbing portion") 32 located in the second region 25 and hidden by the front surface member 22.

Figure 3:
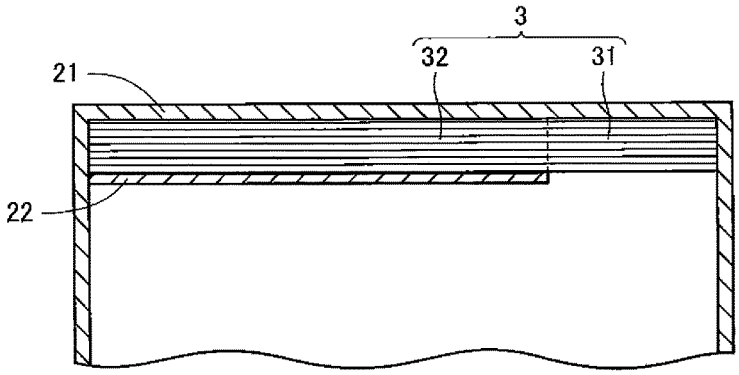
FIG. 3 is a view schematically showing a sectional structure of a sound absorbing material included in a sound absorbing structure according to the first embodiment of the present invention.

The sound absorbing material 3 may be made of a commonly used sound absorber such as glass wool or rock wool, or may be made of a layered sound absorber comprised of a plurality of layer members as shown in FIG. 3. In FIG. 3, both the exposed sound absorbing portion 31 and the hidden sound absorbing portion 32 are comprised of a plurality of layer members that are arranged so as to form layers in the thickness direction. For example, each of the layer members is formed by intricately intertwining polyethylene terephthalate (PET) fibers, and the density thereof is, e.g., 30 kg/m$^3$.

According to the present embodiment, since the front surface of the front surface member 22 and the front surface of a part (the exposed sound absorbing portion 31) of the sound absorbing material 3 are exposed in the room (acoustic room 9), a part of sound produced in the room is reflected by the front surface member 22, and another part of the sound is incident on the exposed sound absorbing portion 31 of the sound absorbing material 3 through the opening 23 and is absorbed by the exposed sound absorbing portion 31.

In the present embodiment, the sound absorbing material 3 has the hidden sound absorbing portion 32 adjoining the exposed sound absorbing portion 31 in the lateral direction. This allows sounds in a high frequency range (hereinafter sometimes simply referred to as "high-pitched sounds") to be absorbed by the exposed sound absorbing portion 31 and allows sounds in a low frequency range (hereinafter sometimes simply referred to as "low-pitched sounds") to be diffracted into the second region 25 and absorbed by the hidden sound absorbing portion 32. Accordingly, sounds in a wide frequency range can be absorbed by the sound absorbing material 3 without increasing the thickness of the sound absorbing material 3.

Figure 4:
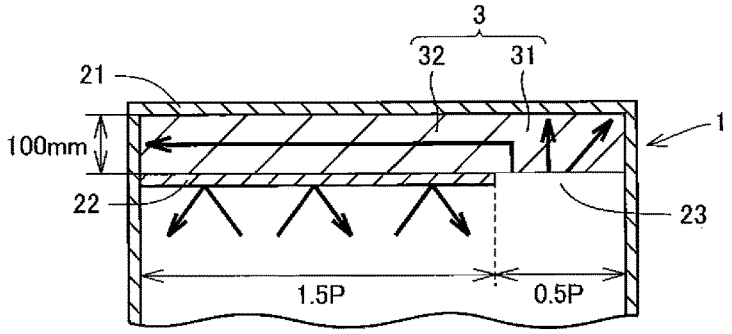
FIG. 4 is a view schematically showing the configuration of the sound absorbing structure according to the first embodiment of the present invention.

The configuration (size or proportions) of the sound absorbing structure 1 that can appropriately absorb low-pitched sounds by the sound absorbing material 3 and that achieves balanced absorption of low- to high-pitched sounds will be described below. FIG. 4 is a view showing an example of the configuration of the sound absorbing structure 1 according to the present embodiment.

As shown in FIG. 4, in the present embodiment, the opening dimension D1 of the opening 23 is 0.5 P (about 500 mm), and the lateral dimension (hereinafter sometimes referred to as the "reflecting wall dimension") D2 of the front surface member 22 is 1.5 P (about 1,500 mm). 1 P represents a single module in building design and indicates 910 mm to 1,000 mm. The opening dimension (D1) of the opening 23 can be regarded as the lateral dimension of the first region 24 (the length dimension in a predetermined direction of the first region 24), and the lateral dimension (D2) of the front surface member 22 can be regarded as the lateral dimension of the second region 25 (the length dimension in the predetermined direction of the second region 25).

The thickness dimension D3 of the sound absorbing material 3 is, e.g., 100 mm. The thickness dimension D3 is equal to the depth dimension of the first region 24 and the second region 25. In FIG. 4, the thickness is shown exaggerated for convenience. In the present embodiment, the exposed sound absorbing portion 31 and the hidden sound absorbing portion 32 have the same thickness. However, the exposed sound absorbing portion 31 may protrude forward beyond the hidden sound absorbing portion 32 by the thickness of the front surface member 22. Alternatively, a decorative panel (not shown) may be attached to the front surface of the exposed sound absorbing portion 31.

Sound absorption performance of the sound absorbing structure 1 having such a configuration will be described with reference to the experimental results using comparative examples. In the experiments, such a layered sound absorber as shown in FIG. 3 was used as the sound absorbing material 3.

Figure 5:
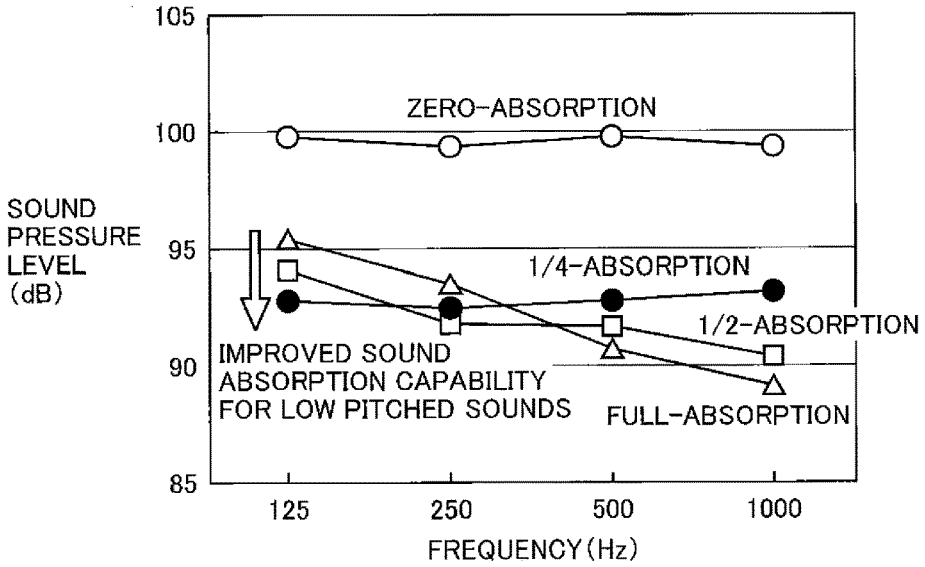
FIG. 5 is a graph showing the experimental results of comparison between the sound absorbing structure according to the first embodiment of the present invention and other wall structures in terms of sound absorption properties for sounds in a low frequency range.
Figure 6:
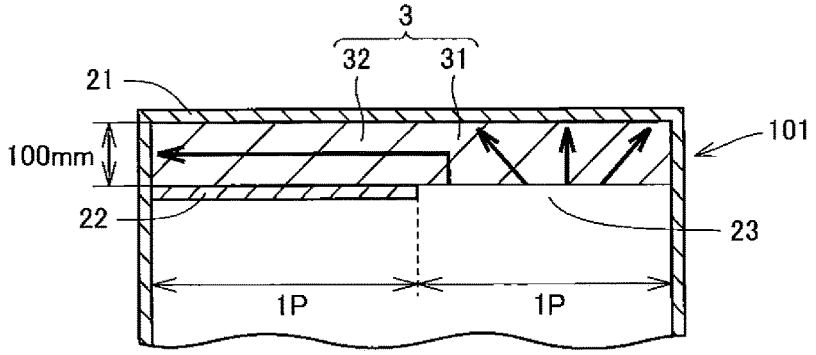
FIG. 6 is a view showing the configuration of a wall structure of a comparative example.
Figure 7:
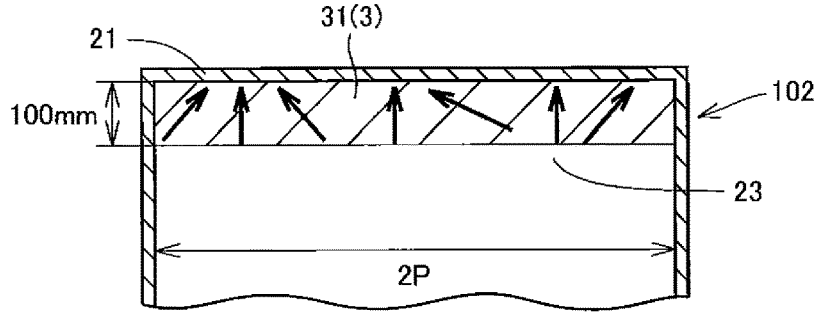
FIG. 7 is a view showing the configuration of a wall structure of a comparative example.
Figure 8:
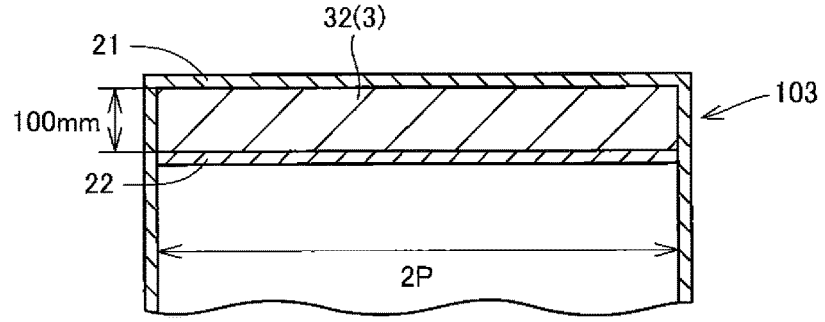
FIG. 8 is a view showing the configuration of a wall structure of a comparative example.

First, sound absorption performance (sound absorption capability) of the sound absorbing structure 1 for low-pitched sounds will be described with reference to FIGS. 5 to 8. FIG. 5 shows the experimental results of comparison between the sound absorbing structure 1 of the present embodiment and other wall structures in terms of sound absorption properties for sounds in the low frequency range. FIGS. 6 to 8 show the configurations of wall structures 101 to 103 of comparative examples, respectively. In the experiments, the lateral width of the rear surface member 21 was fixed to 2 P (about 2,000 mm) and only the opening dimension D1 of the opening 23 was varied.

The sound absorbing structure 1 of the present embodiment is a "¼-absorption" wall structure as the opening dimension D1 is 0.5 P (about 500 mm). The wall structure 101 shown in FIG. 6 is a "½-absorption" wall structure as the opening dimension D1 is 1 P (about 1,000 mm). The wall structure 102 shown in FIG. 7 is a "full-absorption" wall structure as it does not have the front surface member 22 and the opening dimension D1 is 2 P (about 2,000 mm). The wall structure 103 shown in FIG. 8 is a "zero-absorption" wall structure as it does not have the opening 23.

In the graph of FIG. 5, the magnitude of low- to middle-pitched sounds (125 to 1,000 Hz) is expressed as a sound pressure level (unit: dB) for each of the sound absorbing structure 1 and the wall structures 101, 102 in comparison with the "zero-absorption" wall structure 103 of FIG. 8.

In the "full-absorption" wall structure 102 of FIG. 7, the sound absorption coefficient for low-pitched sounds is significantly lower than that for middle-pitched sounds. In the "½-absorption" wall structure 101 of FIG. 6, the sound absorption coefficient for low-pitched sounds is somewhat improved over the wall structure 102, but the sound absorption coefficient for middle-pitched sounds is still higher than that for low-pitched sounds. In the "¼-absorption" sound absorbing structure 1 of the present embodiment, the sound absorption coefficient for low-pitched sounds is further improved and is about the same as that for middle-pitched sounds.

The above results show that the sound absorbing structure 1 having the opening dimension D1 of 0.5 P has excellent sound absorption performance for low-pitched sounds.

Figure 9:
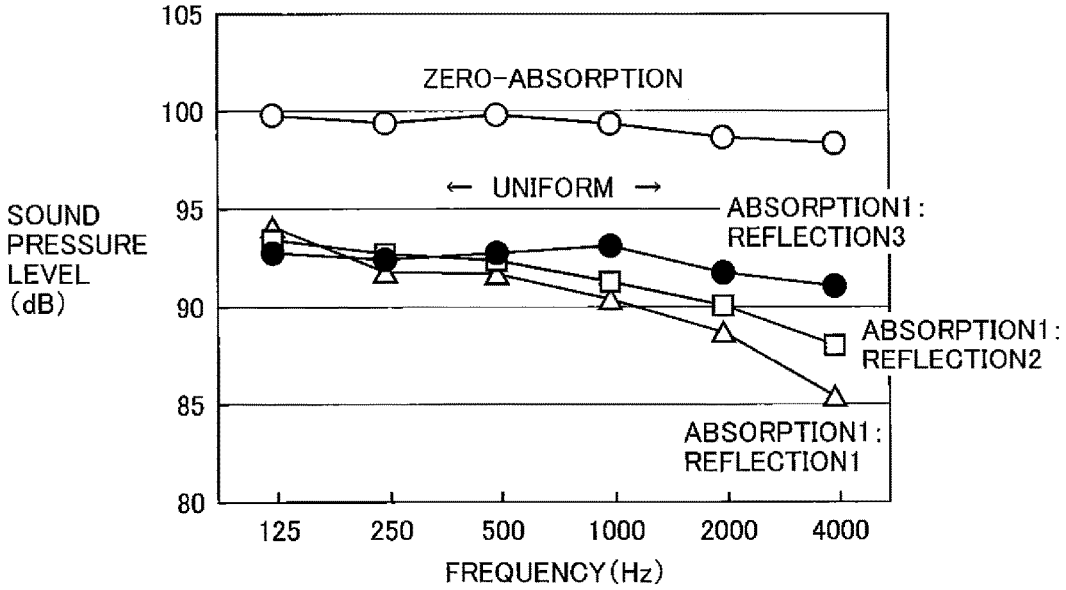
FIG. 9 is a graph showing the experimental results of comparison between the sound absorbing structure according to the first embodiment of the present invention and other wall structures in terms of sound absorption properties for low- to high-pitched sounds.
Figure 10:
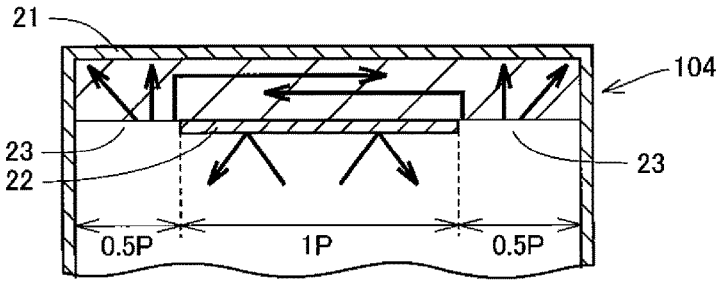
FIG. 10 is a view showing the configuration of a wall structure of a comparative example.
Figure 11:
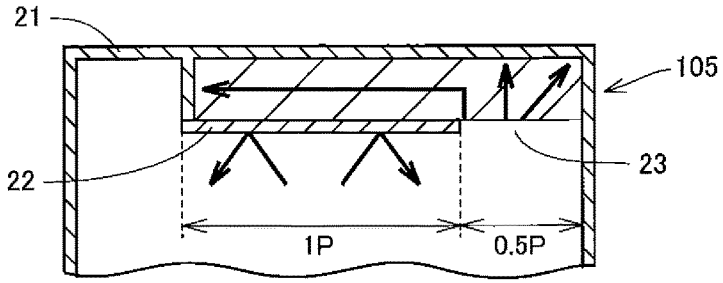
FIG. 11 is a view showing the configuration of a wall structure of a comparative example.

Balance of sound absorption of the sound absorbing structure 1 will be described below with reference to FIGS. 8 to 11. FIG. 9 shows the experimental results of comparison between the sound absorbing structure 1 of the present embodiment and other wall structures in terms of sound absorption properties for low- to high-pitched sounds. FIGS. 10 and 11 show the configurations of wall structures 104, 105 of comparative examples, respectively. The above experimental results of sound absorption properties for low-pitched sounds show that the desirable opening dimension D1 is 0.5 P. Accordingly, in the experiments, the opening dimension D1 was fixed to 0.5 P and only the ratio of the opening dimension D1 to the reflecting wall dimension D2 was varied.

In the sound absorbing structure 1 of the present embodiment, the ratio of the opening dimension D1 to the reflecting wall dimension D2 is 1:3. In the wall structure 104 shown in FIG. 10, the ratio of the opening dimension D1 to the reflecting wall dimension D2 is 1:1, and an opening 23 having an opening dimension D1 of 0.5 P is formed on both sides of the front surface member 22. In the wall structure 105 shown in FIG. 11, the ratio of the opening dimension D1 to the reflecting wall dimension D2 is 1:2.

In the graph of FIG. 9, the magnitude of low- to high-pitched sounds (125 to 4,000 Hz) is expressed as a sound pressure level (unit: dB) for each of the sound absorbing structure 1 and the wall structures 104, 105 in comparison with the "zero-absorption" wall structure 103 of FIG. 8.

In the wall structure 104 in which the "ratio of absorption to reflection is 1:1," the sound pressure level decreases as the sound pitch increases. The wall structure 104 therefore has poor balance of sound absorption. In the wall structure 105 in which the "ratio of absorption to reflection is 1:2," balance of sound absorption is improved over the wall structure 101, but the sound pressure level still decreases as the sound pitch increases. On the other hand, in the sound absorbing structure 1 in which the "ratio of absorption to reflection is 1:3" according to the present embodiment, the sound pressure level is substantially constant for low- to high-pitched sounds. The sound absorbing structure 1 thus has uniform sound absorption properties.

The above results show that the sound absorbing structure 1 in which the ratio of the opening dimension D1 to the reflecting wall dimension D2 is 1:3 achieves balanced absorption of low- to high-pitched sounds.

Figure 12:
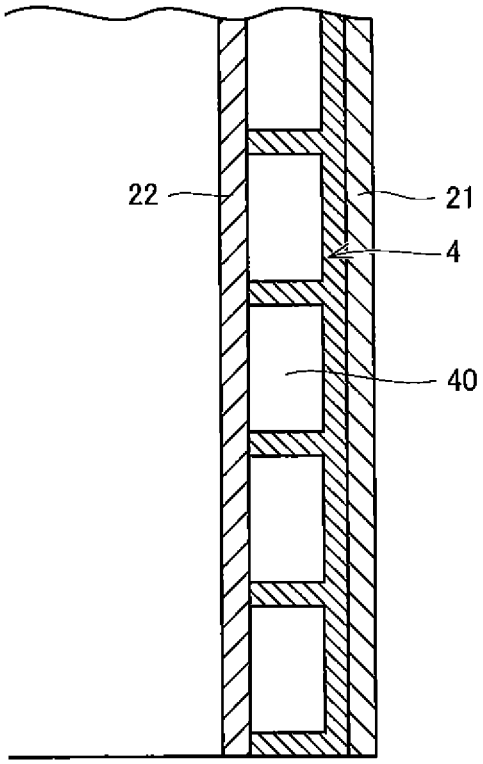
FIG. 12 is a view schematically showing an example of a backing member of the sound absorbing structure according to the first embodiment of the present invention.
Figure 13:
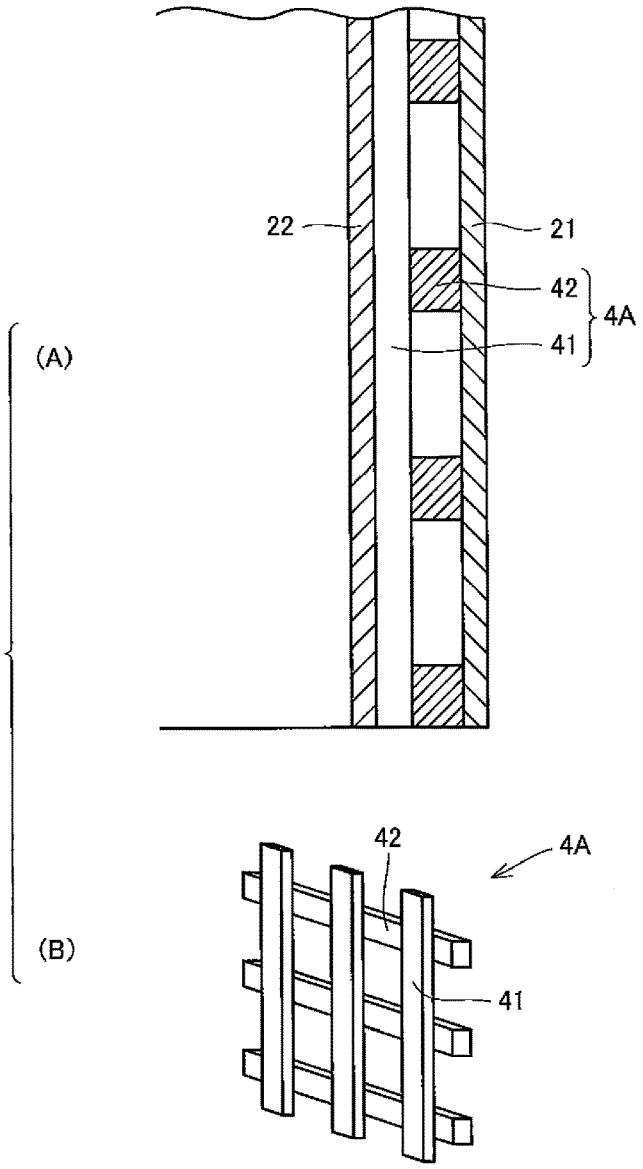
FIGS. 13(A) and 13(B) are views schematically showing another example of the backing member of the sound absorbing structure according to the first embodiment of the present invention.

In order to transmit sound into the second region 25 (the hidden sound absorbing portion 32) in the lateral direction, a backing member that supports the rear surface member 21 and the front surface member 22 needs to have a portion extending through the second region 25 in the lateral direction. Specifically, for example, a backing material 4 as shown in FIG. 12 or a backing material 4A as shown in FIG. 13 may be used. The sound absorbing material 3 is not shown in FIGS. 12 and 13.

The backing material 4 has a plurality of cutouts 40 formed at intervals in the vertical direction so as to extend though the second region 25 in the lateral direction. In FIG. 12, the cutouts 40 face toward the front surface member 22. However, the cutouts 40 may face toward the rear surface member 21.

As shown in FIG. 13(B), the backing material 4A has a plurality of vertical bars 41 and a plurality of lateral bars 42 and is formed in the shape of a duckboard. In this case, for example, the backing material 4A is placed so that the vertical bars 41 contact the front surface member 22 and the lateral bars 42 contact the rear surface member 21, as shown in FIG. 13(A).

As described above, since the sound absorbing structure 1 of the present embodiment is configured so that low-pitched sounds are absorbed by the hidden sound absorbing portion 32, the thickness of the sound absorbing material 3 need not be increased. A larger space is therefore available in the acoustic room 9, which can improve practicality and design. Moreover, excellent sound absorption performance can be achieved with a simple structure. As a result, comfortable acoustics can be created in the acoustic room 9 provided with the sound absorbing structure 1. The acoustic room 9 can thus be provided as a comfortable audio room.

The configuration (size or proportions) of the sound absorbing structure 1 provided in the acoustic room 9 may be as follows.

The ratio of the opening dimension D1 of the opening 23 to the reflecting wall dimension D2 may be 1:2. That is, it is desirable that, when the opening dimension D1 is 1, the reflecting wall dimension D2 be 2 or more. This is because, in the experimental results shown in FIG. 9, even the wall structure 105 in which the "ratio of absorption to reflection is 1:2" exhibited relatively balanced sound absorption properties. Alternatively, the reflecting wall dimension D2 may be merely longer than the opening dimension D2.

Figure 14:
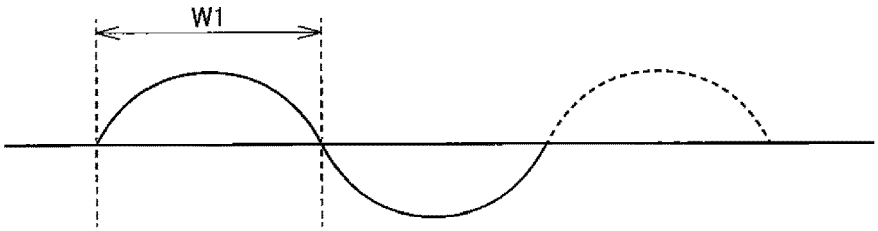
FIG. 14 is a diagram schematically showing sound waves of 125 Hz.

The sound absorption coefficient for each frequency range may vary depending on the material or density of the sound absorbing material 3, but the lateral dimension of the hidden sound absorbing portion 32, namely the reflecting wall dimension D2, need only be equal to or larger than ½ of the wavelength of the sound wave in the low frequency range (125 Hz). FIG. 14 shows the length (½ wavelength) W1. Specifically, the length W1 is approximately 1.5 P. It is desirable that the thickness dimension (D3) of the hidden sound absorbing portion 32, namely the depth dimension of the second region 25, be 100 mm or more.

Even when the depth dimension of the second region 25 (and the first region 24) is larger than 100 mm, the lateral dimension of the hidden sound absorbing portion 32 that absorbs low-pitched sounds, namely the reflecting wall dimension D2, is larger than at least the thickness dimension D3 of the exposed sound absorbing portion 31 that absorbs high-pitched sounds, namely the depth dimension of the first region 24 (and the second region 25).

Second Embodiment

A sound absorbing structure of an acoustic room according to a second embodiment of the present invention will be described below. In the present embodiment, the sound absorbing structure has a function to be able to change acoustics in the low frequency range.

Figure 15:
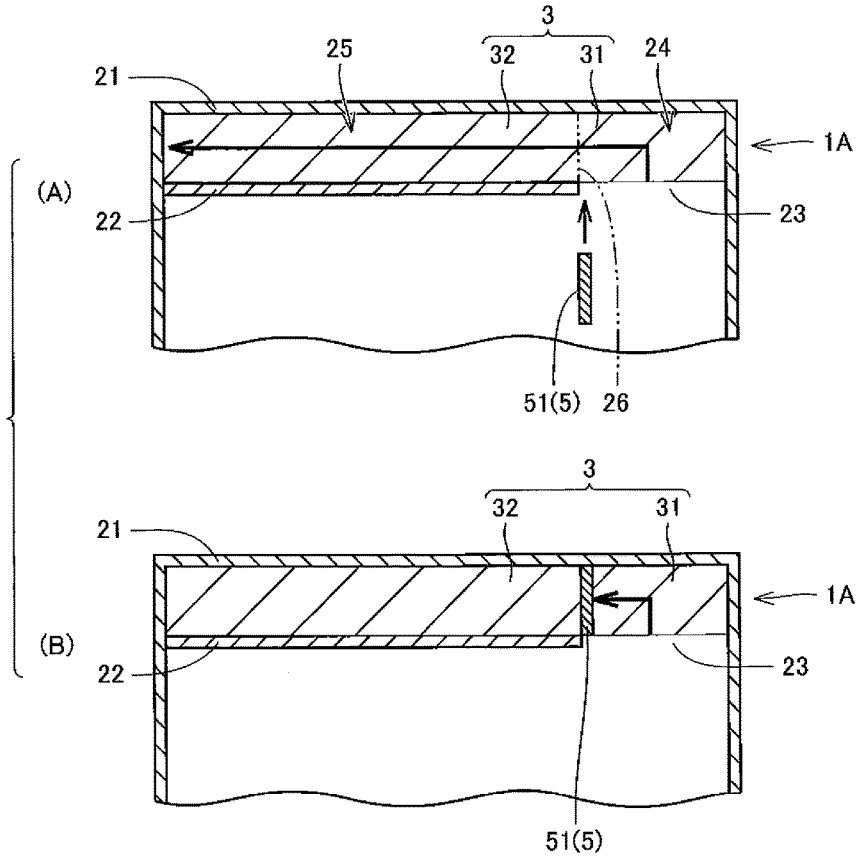
FIG. 15 shows sectional views schematically showing a sound absorbing structure according to a second embodiment of the present invention, where

FIGS. 15(A), 15(B) are sectional views schematically showing a sound absorbing structure 1A according to the second embodiment. The basic configuration of the sound absorbing structure 1A is similar to that of the sound absorbing structure 1 described in the first embodiment. Accordingly, only the differences from the sound absorbing structure 1 of the first embodiment will be described below.

The sound absorbing structure 1A includes a low-pitched sound acoustics variable mechanism 5. The low-pitched sound acoustics variable mechanism 5 can change the sound absorption coefficient for low-pitched sounds by adjusting the opening area of a passage (hereinafter referred to as the "passage area" for sounds in the low frequency range to travel from the first region 24 into the second region 25. That is, the low-pitched sound acoustics variable mechanism 5 can change acoustics in the low frequency range.

The low-pitched sound acoustics variable mechanism 5 typically can be implemented by a plate-like partition member 51. For example, the partition member 51 has a width equal to or larger than the depth dimension of the first region 24 and the second region 25 and has a length substantially equal to the height dimension of the first region 24 and the second region 25 (the height from the floor 91 to the ceiling 96 shown in FIG. 2). The passage area for low-pitched sounds can be reduced by inserting such a partition member 51 from the end on the front surface member 22 side of the opening 23 along or near a boundary plane 26 between the first region 24 and the second region 25 so as to divide the sound absorbing material 3. In this case, the sound absorbing material 3 has a cut or clearance for the partition member 51 to be inserted therein in the thickness direction.

In the state of FIG. 15(A), the partition member 51 is not inserted along the boundary plane 26. Accordingly, the passage area for low-pitched sounds is the maximum, and the passage is fully open. In this case, as described in the first embodiment, low-pitched sounds are sufficiently absorbed like high-pitched sounds. On the other hand, in the state of FIG. 15(B), the partition member 51 is fully inserted along the boundary plane 26. Accordingly, the passage area for low-pitched sounds is zero (minimum), and the passage is fully closed. In this case, the sound absorption coefficient for low-pitched sounds is reduced, and acoustics for low-pitched sounds in the room are therefore increased. For example, the floor 91 and the ceiling 96 of the acoustic room 9 may be provided with a rail (not shown) in order to facilitate insertion and removal of the partition member 51. Alternatively, the partition member 51 may be divided into a plurality of portions in the vertical direction in order to facilitate insertion and removal of the partition member 51.

In order to effectively block or reduce passage of low-pitched sounds into the second region 25 by the partition member 51, it is desirable that the partition member 51 be a rigid plate-like member. This will be described with reference to the experimental results shown in FIG. 16.

Figure 16:
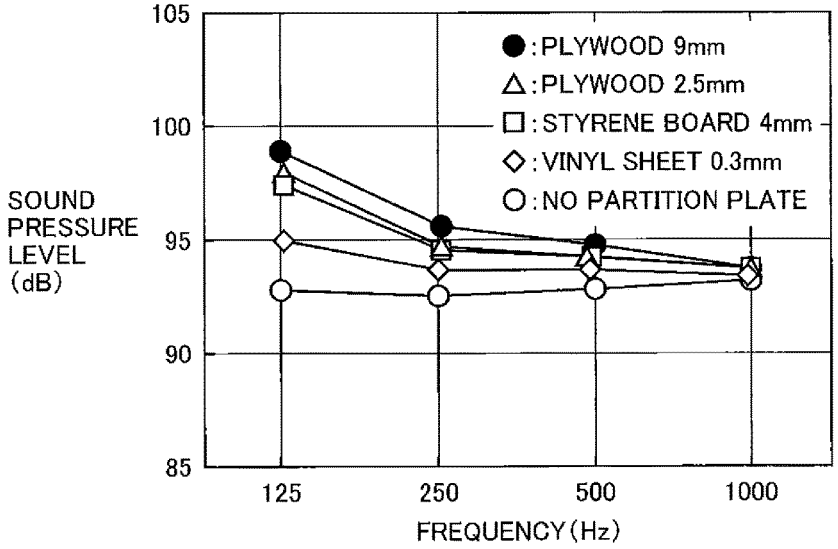
FIG. 16 is a graph showing the relationship between the material of a partition member that forms the low-pitched sound acoustics variable mechanism and the sound absorbing effect.

FIG. 16 is a graph showing the relationship between the material of the partition member 51 and the sound absorbing effect. Partition members 51 made of various materials were used in the experiments, and the experiments were conducted with the partition member 51 fully inserted as shown in FIG. 15(B).

The experimental results of FIG. 16 show that the sound absorption coefficient for low-pitched sounds was not reduced with a non-rigid vinyl sheet, but was reduced as intended with a sheet of rigid plywood or a rigid styrene board. The experimental results also show that, regardless of whether the partition member 51 is rigid or not, fully closing the passage for low-pitched sounds with the partition member 51 does not affect sound absorption properties for high-pitched sounds of 1,000 Hz or higher.

As described above, according to the present embodiment, acoustics for low-pitched sounds can be changed. The sound absorbing structure 1A can therefore be made to function as a woofer or a subwoofer by intentionally reducing the sound absorption coefficient for low-pitched sounds. Comfortable acoustics can therefore be created according to the type of musical instrument to be used etc.

The vertical length of the partition portion 51 is substantially the same as the height dimension of the boundary plane 26. However, the vertical length of the partition portion 51 may be smaller than the height dimension of the boundary plane 26. That is, the partition member 51 may be configured to partially open the passage for low-pitched sounds even when the partition member 51 is fully inserted.

The low-pitched sound acoustics variable mechanism 5 may have other configurations. A modification of the low-pitched sound acoustics variable mechanism 5 will be described.

(Modification)

Figure 17:
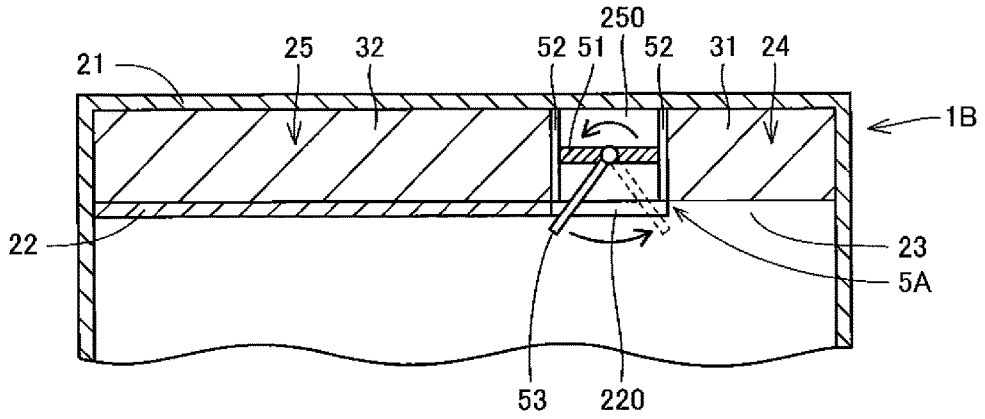
FIG. 17 is a sectional view schematically showing a sound absorbing structure according to a modification of the second embodiment of the present invention.

FIG. 17 is a sectional view schematically showing a sound absorbing structure 1B according to a modification of the second embodiment. The sound absorbing structure 1B includes a low-pitched sound acoustics variable mechanism 5A. Like the low-pitched sound acoustics variable mechanism 5, the low-pitched sound acoustics variable mechanism 5A also includes the partition member 51. However, the low-pitched sound acoustics variable mechanism 5A is different from the low-pitched sound acoustics variable mechanism 5 in the position of the partition member 51 and how to adjust the passage area.

In the low-pitched sound acoustics variable mechanism 5A, the partition member 51 is contained in the second region 25. In this case, the passage area for low-pitched sounds can be adjusted by rotating the partition member 51. That is, the partition member 51 is placed so that the angle with respect to the lateral direction can be changed. It is desirable that the partition member 51 be placed near the inlet of the second region 5 (near the boundary plane 26 described above).

In this case, in order to open and close the passage for low-pitched sounds, the partition member 51 need only be rotatable by 90° about its centerline. The passage is fully closed when the partition member 51 is at 90° with respect to the lateral direction (when the partition member 51 is parallel the thickness direction as in FIG. 15(B)). The passage is fully open when the partition member 51 is at 0° with respect to the lateral direction.

Figure 18:
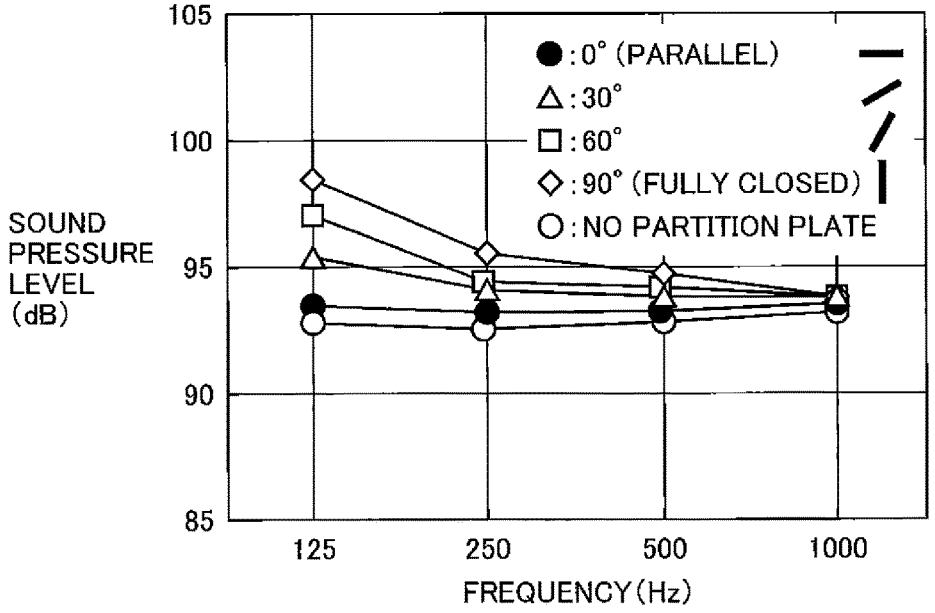
FIG. 18 is a graph showing the relationship between a change in angle of a partition member that forms a low-pitched sound acoustics variable mechanism and sound absorption properties for low-pitched sounds.

FIG. 18 is a graph showing the relationship between a change in angle of the partition member 51 and sound absorption properties for low-pitched sounds. In the experiments, a sheet of plywood with a thickness of 2.5 mm was used as the partition member 51. The experimental results of FIG. 18 show that, even when the partition member 51 is contained near the inlet of the second region 25, the sound absorbing structure 1B exhibit sound absorption properties proportional to a change in angle of the partition member 51.

In the low-pitched sound acoustics variable mechanism 5A, the sound absorbing material 3 may not be provided in the rotation range of the partition member 51 so that the partition member 51 can be rotated in the second region 25. That is, as shown in FIG. 17, the partition member 51 may be placed in a void 250 in the second region 25. For example, the void 250 is a region both sides of which are defined by partition bars 52 arranged at intervals in the vertical direction.

In order to easily perform the operation of rotating the partition member 51 from inside the room, the low-pitched sound acoustics variable mechanism 5A may include an operation lever 53 coupled to a rotation shaft of the partition member 51. In this case, an operation opening 220 that exposes the tip end of the operation lever 53 may be formed in a part of the front surface member 22 which is located in front of the void 250.

In the case where the void 250 is formed in the second region 25 as in this modification, the lateral dimensions of the rear surface member 21 and the front surface member 22 may be increased by the lateral width of the void 250 in order to avoid slight degradation in sound absorption capability for low-pitched sounds in a fully open state. The lateral dimension of the hidden sound absorbing portion 32 can thus be made equal to the dimension thereof in the second embodiment.

Third Embodiment

A sound absorbing structure of an acoustic room according to a third embodiment of the present invention will be described below. In the present embodiment, the sound absorbing structure has a function to be able to change acoustics in the entire frequency range.

Figure 19:
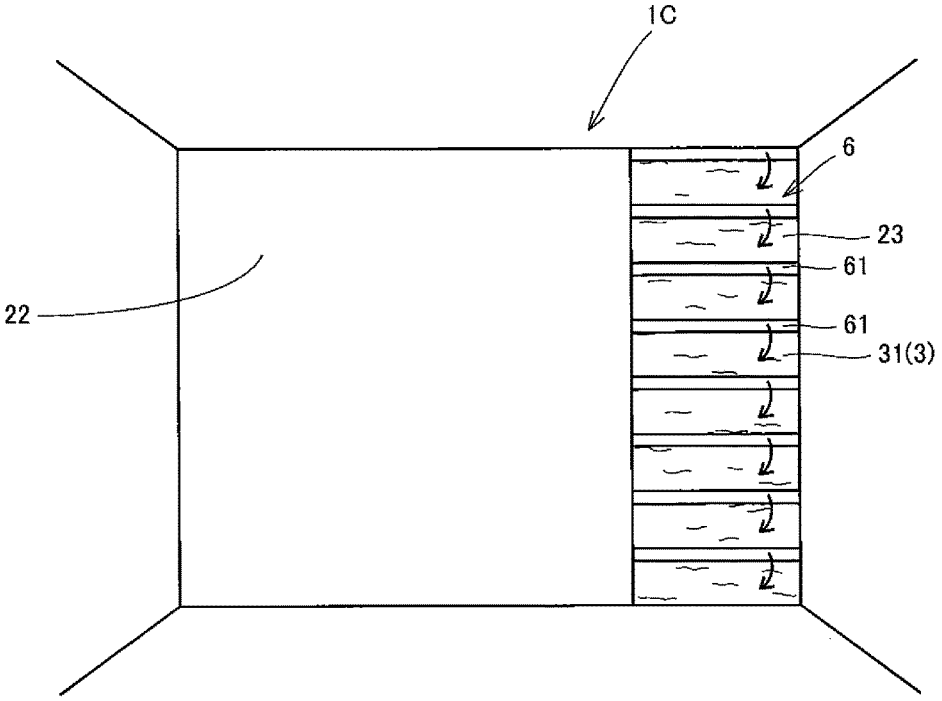
FIG. 19 is a view schematically showing a sound absorbing structure according to a third embodiment of the present invention.

FIG. 19 is a view schematically showing a sound absorbing structure 1C according to the third embodiment. The basic configuration of the sound absorbing structure 1C is similar to that of the sound absorbing structure 1 of the first embodiment. Accordingly, only the differences from the sound absorbing structure 1 of the first embodiment will be described below.

The sound absorbing structure 1C includes an acoustics variable mechanism 6. The acoustics variable mechanism 6 can change the overall sound absorption coefficient by adjusting the exposed area of a sound absorbing surface exposed through the opening 23 (that is, the front surface of the exposed sound absorbing portion 31 or the front surface of the decorative panel).

Specifically, the acoustics variable mechanism 6 is disposed in the opening 23, and for example, is formed by a plurality of slats 61 like a louver. Each slat 61 extends in the lateral direction and its angle can be changed in the vertical direction. Accordingly, the exposed area of the sound absorbing surface of the sound absorbing material 3 can be adjusted by changing the angles of the slats 61. That is, when the entire sound absorbing surface or a part of the sound absorbing surface is covered by the slats 61, the overall sound absorption coefficient is reduced, so that acoustics in the entire frequency range are enhanced.

Accordingly, in the present embodiment as well, comfortable acoustics can be created according to the type of musical instrument to be used etc.

The acoustics variable mechanism 6 is not limited to the configuration shown in FIG. 19 and may be formed by one or more doors.

Fourth Embodiment

The acoustic rooms having sidewalls with a lateral dimension of 2 P are described by way of example in the first to third embodiments. Such a sound absorbing structure as described above is also applicable to acoustic rooms surrounded by sidewalls with other lateral dimensions. An example of the configuration of such an acoustic room will be described below.

Figure 20:
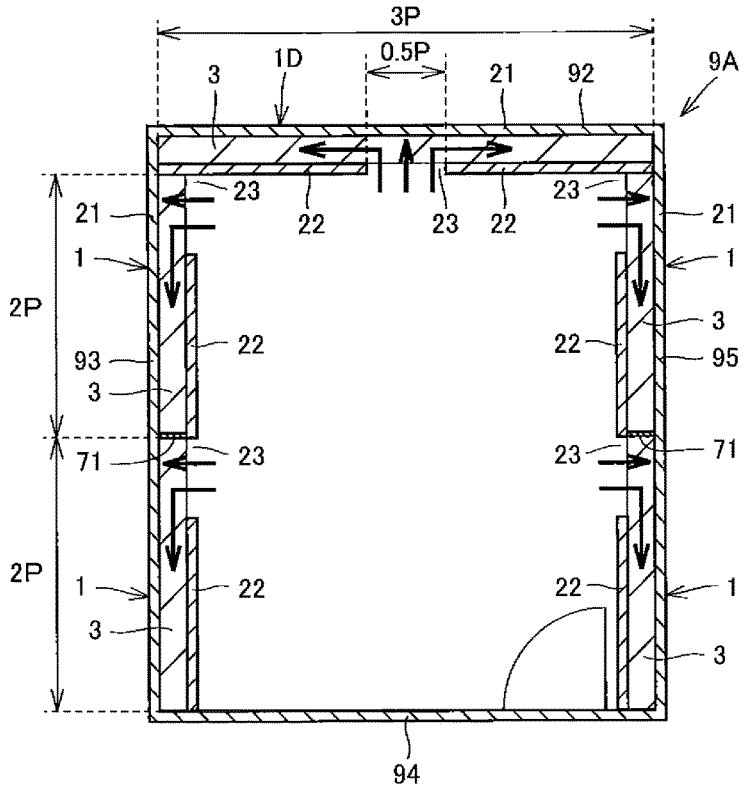
FIG. 20 is a view schematically showing an acoustic room according to a fourth embodiment of the present invention.

FIG. 20 is a view schematically showing an acoustic room 9A according to a fourth embodiment. The acoustic room 9A has sidewalls 92, 94 with a lateral dimension of 3 P (about 3,000 mm) and sidewalls 93, 95 with a lateral dimension of 4 P (about 4,000 mm).

For example, the sound absorbing structure 1 described in the first embodiment is used as a single unit, and two sound absorbing structures 1 are arranged in the lateral direction in each of the sidewalls 93, 95 with a lateral dimension of 4 P. In the present embodiment, the two units are arranged so that the positional relationship between the front surface member 22 and the opening 23 in the lateral direction is the same between the two units. In this case, a partition material 71 that blocks passage of sound may be provided between the units.

Alternatively, two sound absorbing structures 1 may be arranged symmetrically in terms of the positional relationship between the front surface member 22 and the opening 23 so that the openings 23 are located near the corners of the acoustic room 9A. In either case, the rear surface member 21 can be continuous between the two sound absorbing structures 1.

For example, the sidewall 92 with a lateral dimension of 3 P is formed by a sound absorbing structure 1D. The sound absorbing structure 1D has an opening 23 with an opening dimension of 0.5 P in front of the middle part of the rear surface member 21 with a lateral dimension of 3 P, and has a pair of front surface members 22 on both sides of the opening 23. In this case as well, the thickness dimension D3 of the sound absorbing material 3 need only be 100 mm or more.

As described above, in the case where the sidewall has a lateral width larger than 2 P, the overall lateral dimension D2 of the front surface members 22 may be larger than 1.5 P.

Other Embodiments

In the sound absorbing structures of the above embodiments, the front surface member 22 and the opening 23 are located so as to adjoin each other in the lateral direction. However, the front surface member 22 and the opening 23 may be located so as to adjoin each other in the vertical direction. In this case, the opening 23 may be formed in the middle in the vertical direction like the sidewall 92 shown in FIG. 21.

Figure 21:
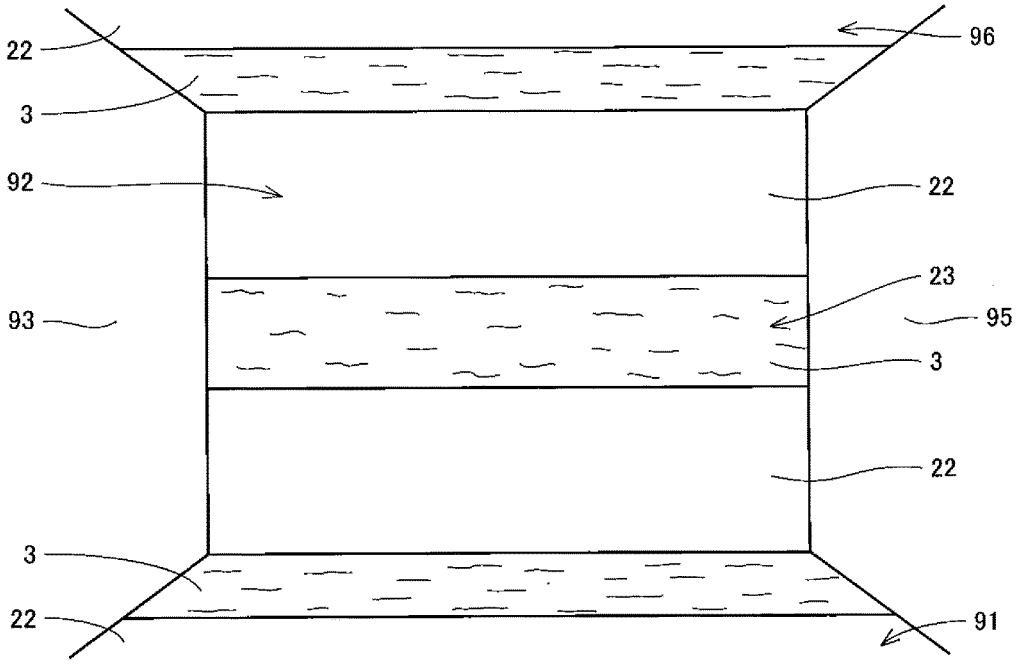
FIG. 21 is a view showing an acoustic room according to a further embodiment of the present invention as viewed from inside the room.

In the above embodiments, the rear surface member 21 and the front surface member 22 of the sound absorbing structure form the sidewalls of the acoustic room. However, the rear surface member 21 and the front surface member 22 of the sound absorbing structure may form the floor 91 and the ceiling 96 of the acoustic room, as shown in FIG. 21. That is, the rear surface member 21 and the front surface member 22 of the sound absorbing structure may form at least one of the sidewalls 92 to 95, the floor 91, and the ceiling 96 of the acoustic room.

Alternatively, only the rear surface member 21 of the sound absorbing structure may form at least one of the sidewalls 92 to 95, the floor 91, and the ceiling 96 of the acoustic room. That is, the front surface member 22 may be merely placed as a reflecting panel in front of a surface (the rear surface member 21) forming the acoustic room.

Alternatively, the sound absorbing structures described in the above embodiments may not be embedded in advance in the acoustic room. That is, the sound absorbing structure may be implemented as such a portable sound absorbing device as shown in FIG. 22.

Figure 22:
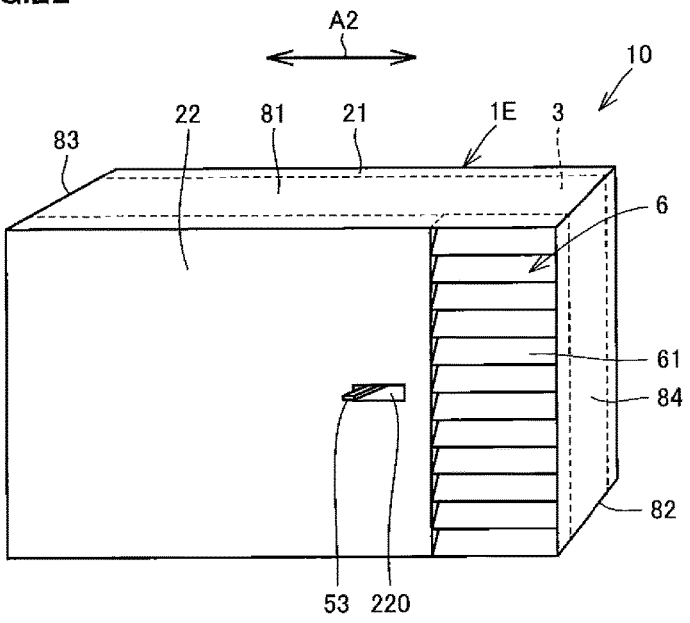
FIG. 22 is a perspective view showing a sound absorbing device according to a still further embodiment of the present invention.

Referring to FIG. 22, a sound absorbing device 10 includes, for example, a sound absorbing structure 1E that is a combination of the sound absorbing structure 1B of the modification of the second embodiment and the sound absorbing structure 1C of the third embodiment. Accordingly, the sound absorbing device 10 has, by way of example, the low-pitched sound acoustics variable mechanism 5A (FIG. 17) and the acoustics variable mechanism 6. The sound absorbing device 10 can thus change acoustics according to the pitch (frequency). FIG. 22 shows the sound absorbing device 10 with the acoustics variable mechanism 6 being fully closed.

In this case, the rear surface member 21 and the front surface member 22 form a part of a housing of the sound absorbing device 10. The sound absorbing device 10 may be surrounded by surface members 81 to 84 covering the upper and lower end faces and both side surfaces of the sound absorbing material 3 as well as by the rear surface member 21 and the front surface member 22.

In the sound absorbing device 10 as well, both the rear surface member 21 and the front surface member 22 have a rectangular shape. Assuming that a predetermined direction shown by arrow A2 in FIG. 22 (the direction in which the front surface member 22 and the opening 23 adjoin each other) is one direction, it is desirable that the length in the one direction of the rear surface member 21 be 2 P and the length in the one direction of the front surface member 22 be 1.5 P. It is desirable that the lengths in the other direction (the direction perpendicular to the one direction) of the rear surface member 21 and the front surface member 22 be 1 P or more.

By installing such a sound absorbing device 10 at a desired position in a room, the room can be used as an audio room. Since the sound absorbing device 10 can change acoustics according to the pitch, the sound absorbing device 10 can function as an audio tune. The sound absorbing device 10 may be installed so that the predetermined direction matches the lateral direction of a sidewall of a room, or may be installed so that the predetermined direction matches the vertical direction of the room.

In the example of the sound absorbing device 10 in FIG. 22, the rear surface member 21 and the front surface member 22 have a rectangular shape. However, the rear surface member 21 and the front surface member 22 are not limited to such a shape. The rear surface member 21 and the front surface member 22 need only have a length at least in the predetermined direction, and the front surface member 22 and the opening 23 need only adjoin each other in the predetermined direction.

The above embodiments are described with respect to the case where the front surface member 22 is shorter in a predetermined direction (e.g., the lateral direction) than the rear surface member 21 and the opening 23 adjoins the front surface member 22 in the predetermined direction. However, the rear surface member 21 and the front surface member 22 may have the same length in the predetermined direction and the opening 23 may be formed in a part of the front surface member 22. In this case, a region located behind the remaining part (reflecting wall portion) of the front surface member 22, i.e., located behind the front surface member 22 excluding the opening 23, corresponds to the second region described above. As in the above embodiments, the first region is a region located behind the opening 23.

For example, even when the front surface member 22 has the opening 23, the opening 23 is located at one end in a predetermined direction of the front surface member 22 and extends in a direction crossing (perpendicular to) the predetermined direction. More specifically, assuming that the predetermined direction is the lateral direction, the opening 23 may extend from the upper end position to the lower end position of the front surface member 22.

Figure 23:
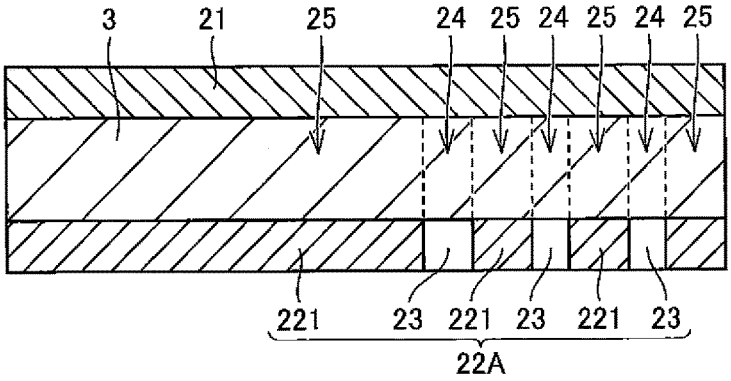
FIG. 23 is a sectional view schematically showing a sound absorbing structure according to a yet further embodiment of the present invention.

As shown in FIG. 23, a front surface member 22A may have a plurality of openings 23. In this case, reflecting wall portions 221 of the front surface member 22A and the openings 23 are located alternately in a predetermined direction. The opening dimension D1 described above may be considered as corresponding to the total length dimension in the predetermined direction of all the openings 23 (or the first regions 24). The reflecting wall dimension D2 may also be considered as corresponding to the total length dimension in the predetermined direction of all the reflecting wall portions 221 (or the second regions 25).

In the second embodiment, it is described that the sound absorbing material 3 may be divided in the case where the low-pitched sound acoustics variable mechanism is provided. However, the sound absorbing material 3 may be divided regardless of whether the low-pitched sound acoustics variable mechanism is provided or not. That is, the sound absorbing material 3 need only be provided in both of the first and second regions 24, 25 that form a region located in front of the rear surface member 21. The sound absorbing material 3 may not extend from the first region 24 to the second region 25.

Figure 24:
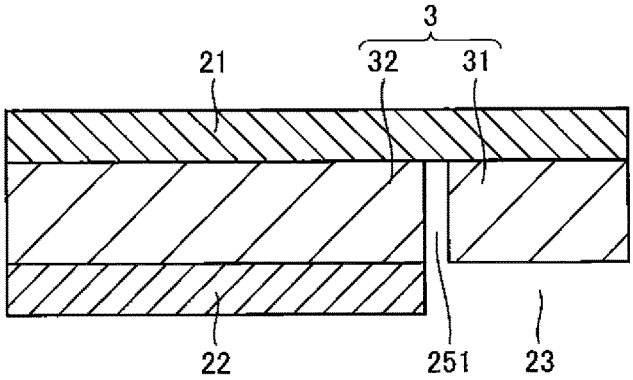
FIG. 24 is a sectional view schematically showing a sound absorbing structure according to a yet further embodiment of the present invention.

For example, as shown in FIG. 24, clearance 251 may be provided in the boundary portion between the first region 24 and the second region 25. In this case, the exposed sound absorbing portion 31 and the hidden sound absorbing portion 32 may be separated from each other by the clearance 251.

Figure 25:
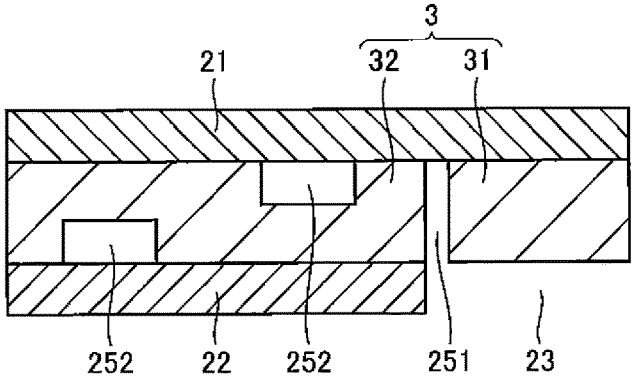
FIG. 25 is a sectional view schematically showing a sound absorbing structure according to a yet further embodiment of the present invention.
Figure 26:
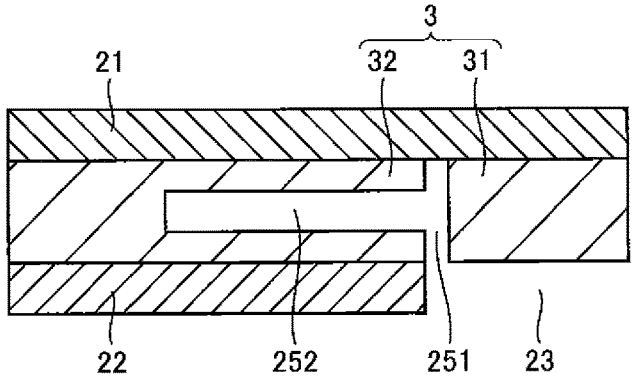
FIG. 26 is a sectional view schematically showing a sound absorbing structure according to a yet further embodiment of the present invention.

Moreover, a void, that is, a portion where there is no sound absorbing material 3 (hidden sound absorbing portion 32), may be formed in the second region 25. In the example of FIG. 25, a void 252 is formed in a part in the lateral direction of the second region 25. A plurality of voids 252 may be provided. As shown in FIG. 26, a void 252 may communicate with the clearance 251 provided in the boundary portion between the first region 24 and the second region 25.

Figure 27:
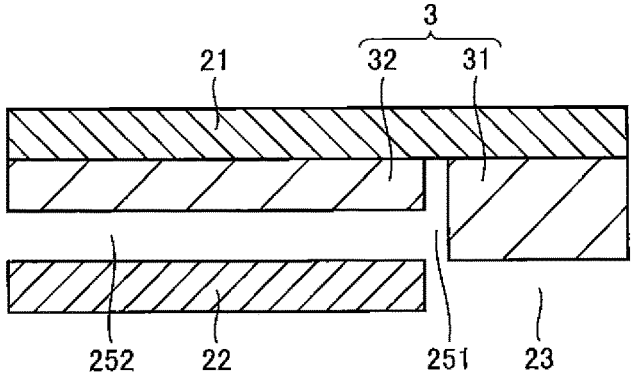
FIG. 27 is a sectional view schematically showing a sound absorbing structure according to a yet further embodiment of the present invention.

Alternatively, as shown in FIG. 27, a void 252 may be formed so that the thickness dimension of the hidden sound absorbing portion 32 becomes smaller than that of the exposed sound absorbing portion 31 and so that the void 252 adjoins one or both of the rear surface member 21 and the front surface member 22 in the second region 25.

Figure 28:
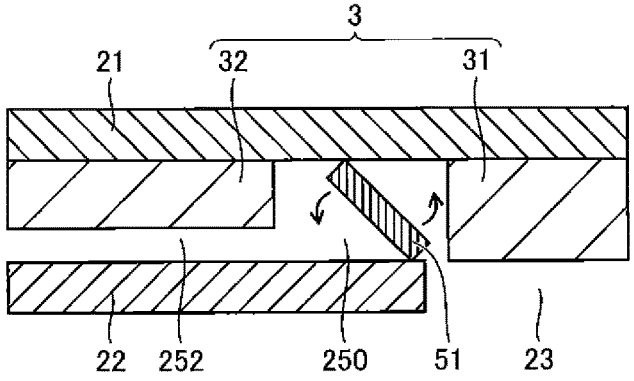
FIG. 28 is a sectional view schematically showing a sound absorbing structure according to a yet further embodiment of the present invention.

As shown in FIG. 28, a void 252 may be formed in the second region 25 so as to connect to the void 250 (see FIG. 17) where the partition member 51 is rotated.

Although the embodiments of the present invention are described above, the embodiments and the modifications thereof may be combined as appropriate.

The embodiments disclosed herein are by way of example in all respects and should not be interpreted as restrictive. The scope of the present invention is defined by the claims rather than by the above description, and the invention is intended to cover all changes and modifications within the spirit and scope of the invention as defined by the claims.

REFERENCE SIGNS LIST

1, 1A, 1B, 1C, 1D, 1E Sound Absorbing Structure
3 Sound Absorbing Material
4, 4A Backing Member
5, 5A Low-Pitched Sound Acoustics Variable Mechanism
6 Acoustics Variable Mechanism
9, 9A Acoustic Room
10 Sound Absorbing Device
21 Rear Surface Member
22, 22A Front Surface Member
23 Opening
24 First Region
25 Second Region
26 Boundary Plane
31 Exposed Sound Absorbing Portion
32 Hidden Sound Absorbing Portion
41 Vertical Bar
42 Lateral Bar
51 Partition Member
52 Partition Bar
53 Operation Lever
61 Slat
71 Partition Material
81 to 84 Surface Member
91 Floor
92 to 95 Sidewall
96 Ceiling
101 to 105 Wall Structure
220 Operation Opening
221 Reflecting Wall Portion
250, 252 Void
251 Clearance

The invention claimed is:

1. An acoustic room, comprising a sound absorbing structure, the sound absorbing structure comprising:

a rear surface member having a length in a predetermined direction;

a front surface member that is parallel to said rear surface member and is separated forward from said rear surface member and that is shorter in said predetermined direction than said rear surface member;

a sound absorbing material in front of said rear surface member; and an opening that adjoins said front surface member in said predetermined direction, wherein said sound absorbing material is in both a first region located behind said opening and a second region sandwiched between said front surface member and said rear surface member, a part of said sound absorbing material which is located in said first region absorbs sounds in a high frequency range, a part of said sound absorbing material which is located in said second region absorbs sounds in a low frequency range, a length dimension in said predetermined direction of said second region is larger than that in said predetermined direction of said first region when the opening is fully open, and said rear surface member forms at least one of sidewalls, a floor, and a ceiling of the acoustic room.

2. The sound absorbing structure according to claim 1, wherein a ratio between said length dimension of said first region and said length dimension of said second region D1:D2, where D1 is 1, and D2 is 2 or more.

3. The sound absorbing structure according to claim 1, wherein the length dimension in said predetermined direction of said second region is larger than a depth dimension of said first region.

4. The sound absorbing structure according to claim 1, wherein the length dimension of said first region is in a range of about 455 mm to about 500 mm.

5. The sound absorbing structure according to claim 1, further comprising:

a low-pitched sound acoustics variable mechanism that is disposed in said second region and configured to change acoustics in the low frequency range.

6. The sound absorbing structure according to claim 1, further comprising:

a low-pitched sound acoustics variable mechanism including a partition member that is configured to adjust an opening area of a passage for said sounds in the low frequency range to travel from said first region into said second region.

7. The sound absorbing structure according to claim 6, wherein said partition member comprises a plate-like member having an angle with respect to said predetermined direction, the plate-like member being configured to rotate and change the angle with respect to said predetermined direction, and said second region includes a void within which said plate-like member is configured to rotate.

8. The sound absorbing structure according to claim 1, wherein said sound absorbing material extends from said first region to said second region.

9. The sound absorbing structure according to claim 1, further comprising:

an acoustics variable mechanism configured to change acoustics by adjusting an exposed area of a sound absorbing surface exposed through said opening.

10. An acoustic room, comprising a sound absorbing structure, the sound absorbing structure comprising:

a rear surface member having a length in a predetermined direction;

a front surface member that is parallel to said rear surface member and is separated forward from said rear surface member; and a sound absorbing material in front of said rear surface member, wherein said front surface member has an opening partially in said predetermined direction, and said sound absorbing material is in both a first region located behind said opening and a second region located behind a reflecting wall portion, said reflecting wall portion being said front surface member excluding said opening, a part of said sound absorbing material which is located in said first region absorbs sounds in a high frequency range, a part of said sound absorbing material which is located in said second region absorbs sounds in a low frequency range, a length dimension in said predetermined direction of said second region is larger than that in said predetermined direction of said first region when the opening is fully open, and said rear surface member forms at least one of sidewalls, a floor, and a ceiling of the acoustic room.

11. A sound absorbing structure that absorbs sound, comprising:

a rear surface member having a length in a predetermined direction;

a front surface member that is parallel to said rear surface member and is separated forward from said rear surface member and that is shorter in said predetermined direction than said rear surface member;

a sound absorbing material in front of said rear surface member; and an opening that adjoins said front surface member in said predetermined direction, wherein said sound absorbing material is in both a first region located behind said opening and a second region sandwiched between said front surface member and said rear surface member, and a low-pitched sound acoustics variable mechanism including a partition member that is configured to adjust an opening area of a passage for said sounds in a low frequency range to travel from said first region into said second region.

* * * * *